US006998795B2

(12) United States Patent
Chiou

(10) Patent No.: US 6,998,795 B2
(45) Date of Patent: Feb. 14, 2006

(54) POWER FACTOR CORRECTION CIRCUIT FOR ELECTRONIC BALLAST

(76) Inventor: Yih-Fang Chiou, 1F, No. 132, Lane 39, Sec. 1, Shih-Pai Road, Pei-Tou Dist., Taipei (TW)

( * ) Notice: Subject to any disclaimer, the term of this patent is extended or adjusted under 35 U.S.C. 154(b) by 0 days.

(21) Appl. No.: 10/841,032

(22) Filed: May 6, 2004

(65) Prior Publication Data

US 2005/0248295 A1 Nov. 10, 2005

(51) Int. Cl.
*H05B 41/16* (2006.01)
*H05B 39/04* (2006.01)

(52) U.S. Cl. ..... 315/291; 315/DIG. 5
(58) Field of Classification Search ..... 315/127, 315/224, 291, 307, DIG. 5
See application file for complete search history.

(56) References Cited

U.S. PATENT DOCUMENTS 5,519,289 A * 5/1996 Katyl et al. ..... 315/224
5,559,395 A * 9/1996 Venkitasubrahmanian et al. ..... 315/247
6,222,322 B1 * 4/2001 Stack ..... 315/119
6,781,326 B1 * 8/2004 Stack ..... 315/291

* cited by examiner

*Primary Examiner*—Wilson Lee
*Assistant Examiner*—Minh Dieu A

(57) ABSTRACT

A power factor correction circuit for the electronic ballast of a fluorescent lamp is provided. The power factor correction circuit is located between a bridge rectifier circuit and A high frequency oscillation circuit of the electronic ballast, and includes a filtering capacitor charge/discharge circuit and a feedback circuit taking input from a filament of the fluorescent lamp. The electronic ballast equipped with the power factor correction circuit achieves a power factor >0.95, a lamp current crest factor <1.7, and a total harmonic distortion <10%.

2 Claims, 4 Drawing Sheets

POWER FACTOR CORRECTION CIRCUIT FOR ELECTRONIC BALLAST

FIELD OF THE INVENTION

The present invention generally relates to electronic ballast of fluorescent lamps, and more specifically to a power factor correction circuit for the electronic ballast of the fluorescent lamp.

BACKGROUND OF THE INVENTION

Electronic ballasts, due to its small form factor, light weight, less power consumption, and stable light beams, have become the mainstream of fluorescent lamp ballast. Basically the electronic ballast is a combination of circuits that converts alternating current (AC) into direct current (DC) and then from DC back to AC. More specifically, one of the conventional electronic ballasts converts the AC voltage from the mains into a DC voltage, and then converts the DC voltage, through high frequency oscillation, into a high frequency, high level AC voltage to excite the fluorescent lamp. As shown in FIG. 1, the conventional electronic ballast contains a bridge rectifier circuit 10, a DC filter circuit 12, a high frequency oscillation circuit 14, and a lamp circuit 16. For the sake of simplicity and cost reduction, the DC filter circuit 12 usually only contains a filtering capacitor C1.

The bridge rectifier circuit 10 that rectifies an input AC voltage to charge and discharge the filtering capacitor C1 and a DC voltage with a ripple is thereby developed across the filtering capacitor C1. Because the AC voltage Vs can charge the filtering capacitor C1 only around the crest and trough of its waveform where it has a large enough voltage, the input AC current Is therefore has an impulse waveform. Moreover, in order to reduce the ripple of the DC voltage (i.e. to enhance the filtering effect), usually a capacitor with a large capacitance is used as the filtering capacitor C1. This, however. causes the impulse waveform of the input AC current Is to become even acuter.

FIG. 2 is a waveform diagram showing the input AC voltage Vs and current Is of the conventional electronic ballast. As shown in FIG. 2, the input AC current Is has a seriously distorted impulse waveform. The acute impulses cause an increase in the amount of harmonics (especially the third order harmonics) and a reduction of power factor. The increase of harmonics intensifies electromagnetic interference. If a large number of such electronic ballasts are used simultaneously, there is a high possibility to cause a tripping of the power supply system or even a fire accident in the worst case. On the other hand, a reduction of power factor would increase the power consumption of the power supply system and therefore the power bill as well.

A reduction in the capacitance of the filtering capacitor C1 could indeed abate the distortion of the input AC current Is, reduce the amount of harmonics, and improve the power factor. The DC voltage developed across the filtering capacitor C1, however, would have a more fluctuant ripple. This in turn causes the crest factor of the current of the lamp tube 17 (the peak value divided by the effective value of the lamp current) to exceed the normal rating and thereby reduce the lifespan of the lamp tube 17. In summary, for the conventional electronic ballasts, reducing input AC current harmonics/increasing power factor and reducing lamp current crest factor are contradictory to each other.

Most, if not all, of the commercially available electronic ballasts, even though usually branded as "high efficiency," commonly have a total harmonic distortion $\geqq 10\%$, power factor $\approx 0.5$, and lamp current crest factor $\geqq 1.7$. In other words, these so-called "high efficient" electronic ballasts actually have a high amount of harmonics and a rather low power factor. The term "high efficiency," therefore, actually refers to the high frequency lamp lighting. To achieve the true high efficiency, a correction circuit must be added in the electronic ballasts to overcome the foregoing limitations and disadvantages of the conventional electronic ballasts.

Currently, to reduce the amount of harmonics of the input AC current and to increase the power factor at the same time, there are generally two types of correction circuits: the active ones and the passive ones. The active power factor correction circuits adopt active elements and therefore have a complex structure, bulky form factor, and a higher cost. The passive power factor correction circuits can only achieve limited improvement and therefore have little value in real-life applications.

SUMMARY OF THE INVENTION

The present invention provides a power factor correction circuit, which comprises a plurality of diodes and capacitors and is located between a bridge rectifier circuit and a high frequency oscillation circuit to replace a single-capacitor DC filter circuit of the conventional electronic ballast. The power factor correction circuit according to the present invention comprises a filtering capacitor charge/discharge circuit and a feedback circuit taking input from a lamp filament. The former offers a smaller equivalent filtering capacitance so that the input AC current has a smoother waveform and thereby a less amount of harmonics is achieved. The former also offers a larger equivalent capacitance so that the RC time constant is increased when discharging to the load. This in turn reduces the ripple fluctuation and therefore the crest factor of the lamp current. On the other hand, the latter further adds the high frequency voltage feedback from the lamp filament onto the low frequency DC voltage output from the bridge rectifier circuit so that the waveform of the input AC current can further approach true sine wave.

The power factor correction circuit provided by the present invention achieves simultaneously a low amount of input AC current harmonics (the total harmonic distortion $<10\%$), a high power factor (the power factor $>0.95$), and a less-than-rating lamp current crest factor (the lamp current crest factor $<1.7$). The provided power factor correction circuit also has advantages, such as small form factor, low cost, and high working reliability. The power factor correction circuit according to the present invention is especially suitable for application in self-excited electronic ballasts with small to medium power consumption.

The foregoing and other objects, features, aspects and advantages of the present invention will become better understood from a careful reading of a detailed description provided herein below with appropriate reference to the accompanying drawings.

DETAILED DESCRIPTION OF THE PREFERRED EMBODIMENT

A power factor correction circuit provided by the present invention is structured on and works along with a conventional electronic ballast circuit. A preferred embodiment of the power factor correction circuit in accordance with the present invention is described in details as follows.

Figure 3:
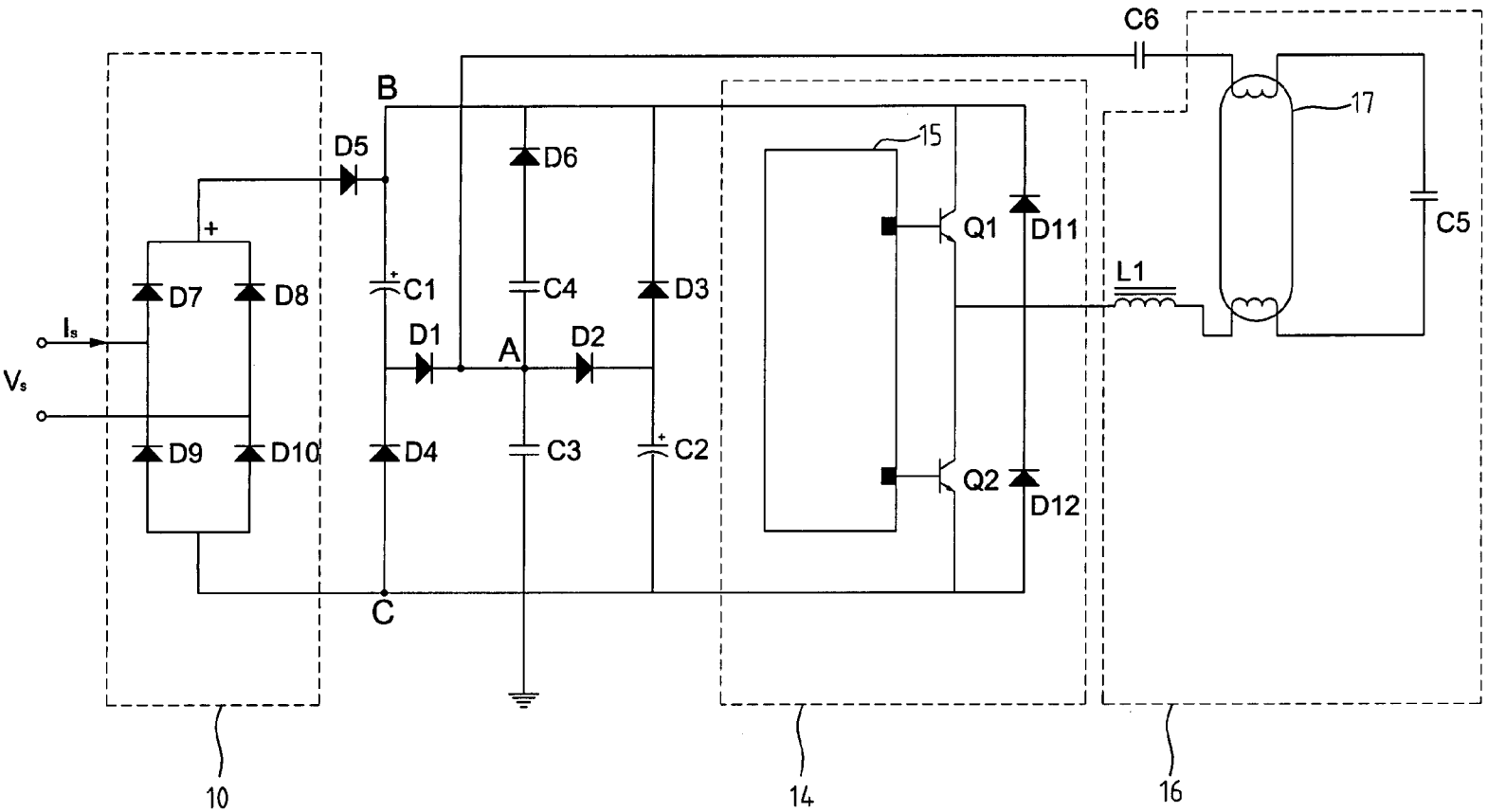
FIG. 3 is a circuit diagram of an electronic ballast according to a preferred embodiment of the present invention.

FIG. 3 is a circuit diagram of the electronic ballast according to the preferred embodiment of the present invention. As shown in FIG. 3, a bridge rectifier circuit 10, a high frequency oscillation circuit 14, and a lamp circuit 16 of the electronic ballast of the present invention are generally identical to the counterparts employed in a conventional electronic ballast and thus, some details may be neglected for simplifying the present description.

The power factor correction circuit provided by the present invention comprises a filtering capacitor charge/discharge circuit and a feedback circuit. Details about the filtering capacitor charge/discharge circuit are explained first as follows.

Diodes D1–D5 and capacitors C1 and C2 constitute the filtering capacitor charge/discharge circuit. A positive output terminal of the bridge rectifier circuit 10 connects to anode of a diode D5. Between a point B at cathode of diode D5 and a point C at a negative output terminal of the bridge rectifier circuit 10, a filtering capacitor C1 and a diode D4 are arranged in a series connection. Anode of the diode D4 is connected to the point C. Also arranged between the points B and C in a series connection are a diode D3 and a filtering capacitor C2 that are parallel to the C1 and D4 connection. Cathode of the diode D3 is connected to the point B. The interconnection point between the filtering capacitor C1 and diode D4 connects to the interconnection point between the diode D3 and filtering capacitor C2 via series-connected diodes D1 and D2. Cathode of the diode D4 is connected to anode of the diode D1. Cathode of the diode D2 is connected to anode of the diode D3.

In the filtering capacitor charge/discharge circuit, the current charging the filtering capacitors C1 and C2 flows from the point B to the point C through the filtering capacitor C1, diodes D1 and D2, and the filtering capacitor C2. On the other hand, the current discharged from the filtering capacitor C1 flows through the point B, the load, the point C, the diode D4, and then back to the filtering capacitor C1. Similarly, the current discharged from the filtering capacitor C2 flows through the diode D3, the point B, the load, the point C, and then back to the filtering capacitor C2.

From the point B, the DC voltage output from the bridge rectifier circuit 10 and the diode D5, on one hand, drives the high frequency oscillation circuit 14 and, on the other hand, charges the filtering capacitor C1 and C2 through the aforementioned charging path. In the charging path, the filtering capacitors C1 and C2 actually form a series connection. Assuming the diodes D1 and D2 are ideal (that is, ignoring their conductive resistances) and the capacitances of the filtering capacitors C1 and C2 are both C, the equivalent filtering capacitance equals to $(C\times C)/(C+C)=C/2$ when the filtering capacitors C1 and C2 are charged. That is, the equivalent filtering capacitance when both filtering capacitor C1 and C2 are used is 50% less than when a single filtering capacitor C1 or C2 is used. Due to this reduction of equivalent filtering capacitance, the input AC current Is has a smoother waveform, fewer amounts of harmonics, and higher power factor.

When the DC voltage at the point B is less than the sum of the voltages of the filtering capacitors C1 and C2, the filtering capacitors C1 and C2 discharge to the load in parallel. Assuming the diodes D1 and D2 are ideal (that is, ignoring their conductive resistance) and the capacitances of the filtering capacitors C1 and C2 are both C, the equivalent filtering capacitance equals to $(C+C)=2C$ when the filtering capacitors C1 and C2 discharge. That is, the equivalent filtering capacitance when both filtering capacitor C1 and C2 are used is 100% more than when a single filtering capacitor C1 or C2 is used. The RC time constant when the filtering capacitors C1 and C2 discharge therefore is 100% more than when a single filtering capacitor C1 or C2 is used. Due to this increase of equivalent filtering capacitance, the DC voltage and the current of the lamp tube 17 would be less fluctuant and the lamp current would have a lower crest factor.

Figure 1:
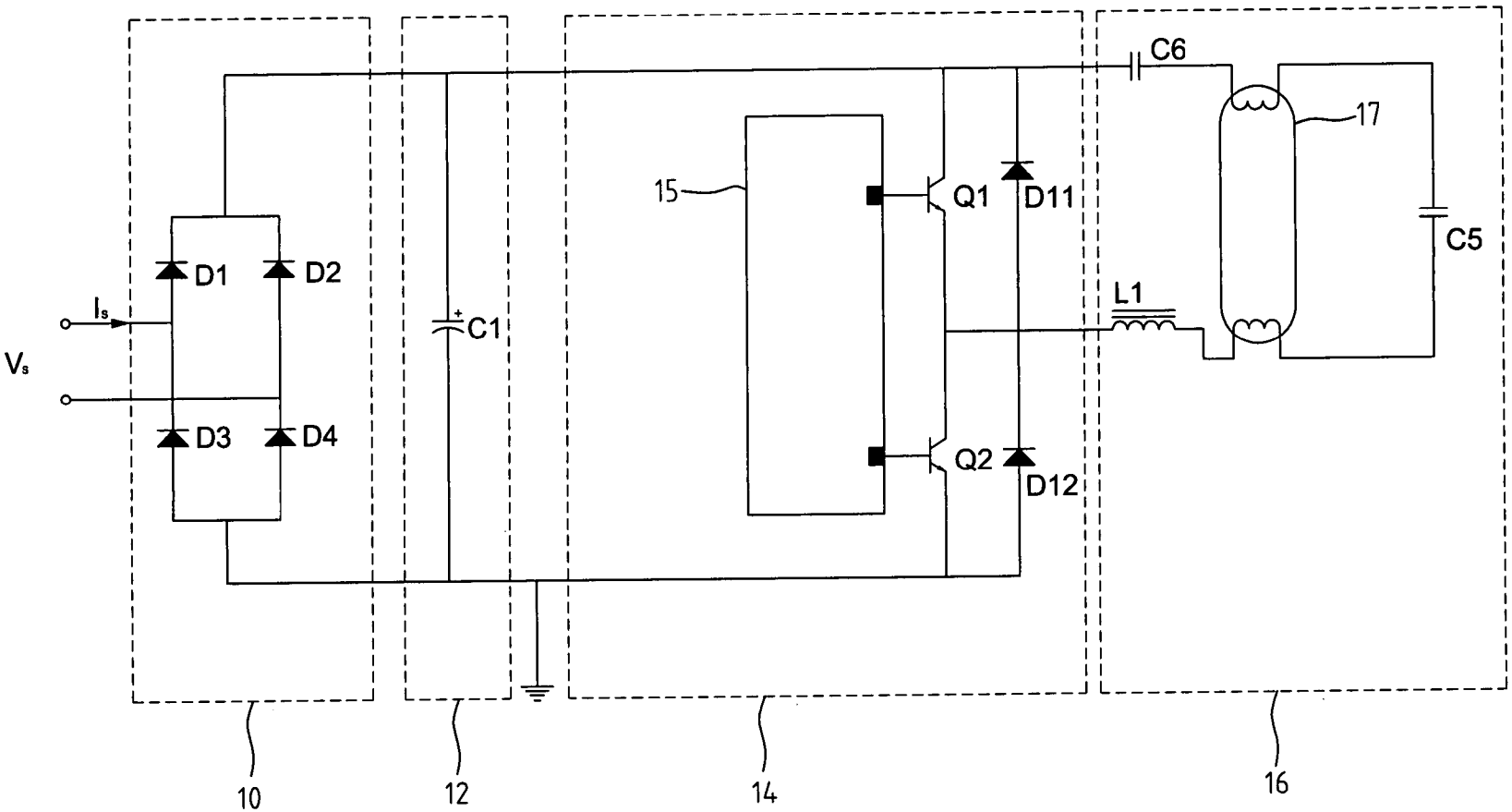
FIG. 1 is a circuit diagram of a conventional electronic ballast.

The details of the feedback circuit will be described as follows. As shown in FIG. 1, within the conventional lamp circuit 16, a filament terminal of the lamp tube 17 is connected to an output of the high frequency oscillation circuit 14 via a coupling capacitor C6. Within the preferred embodiment of the present invention, as shown in FIG. 3, a filament terminal of the lamp tube 17 is connected via the coupling capacitor C6 to the point A between the diodes D1 and D2 of the filtering capacitor charge/discharge circuit. The point A, on one hand, connects to the point C via a capacitor C3 and, on the other hand, connects to the point B via a series-connected capacitor C4 and diode D6. Cathode of the diode D6 is connected to the point B.

The high frequency signal at the filament terminal of the lamp tube 17 reaches the point A via the coupling capacitor C6. The positive halves of the periods of the high frequency signal charge the filtering capacitor C2 via the diode D2 and the negative halves of the periods of the high frequency signal charge the filtering capacitor C1 via the diode D1. Moreover, the high frequency signal is rectified by the diode D6 and added to the low-frequency DC voltage at the point B. The filtering capacitor charge/discharge circuit then filters the sum of the two voltages. The addition of the high frequency signal makes the waveform of the input AC current Is smoother and closer to the sine wave. This in turn further reduces the ripple of the DC voltage and therefore the crest factor of the current of the lamp tube 17 as well.

Figure 2:
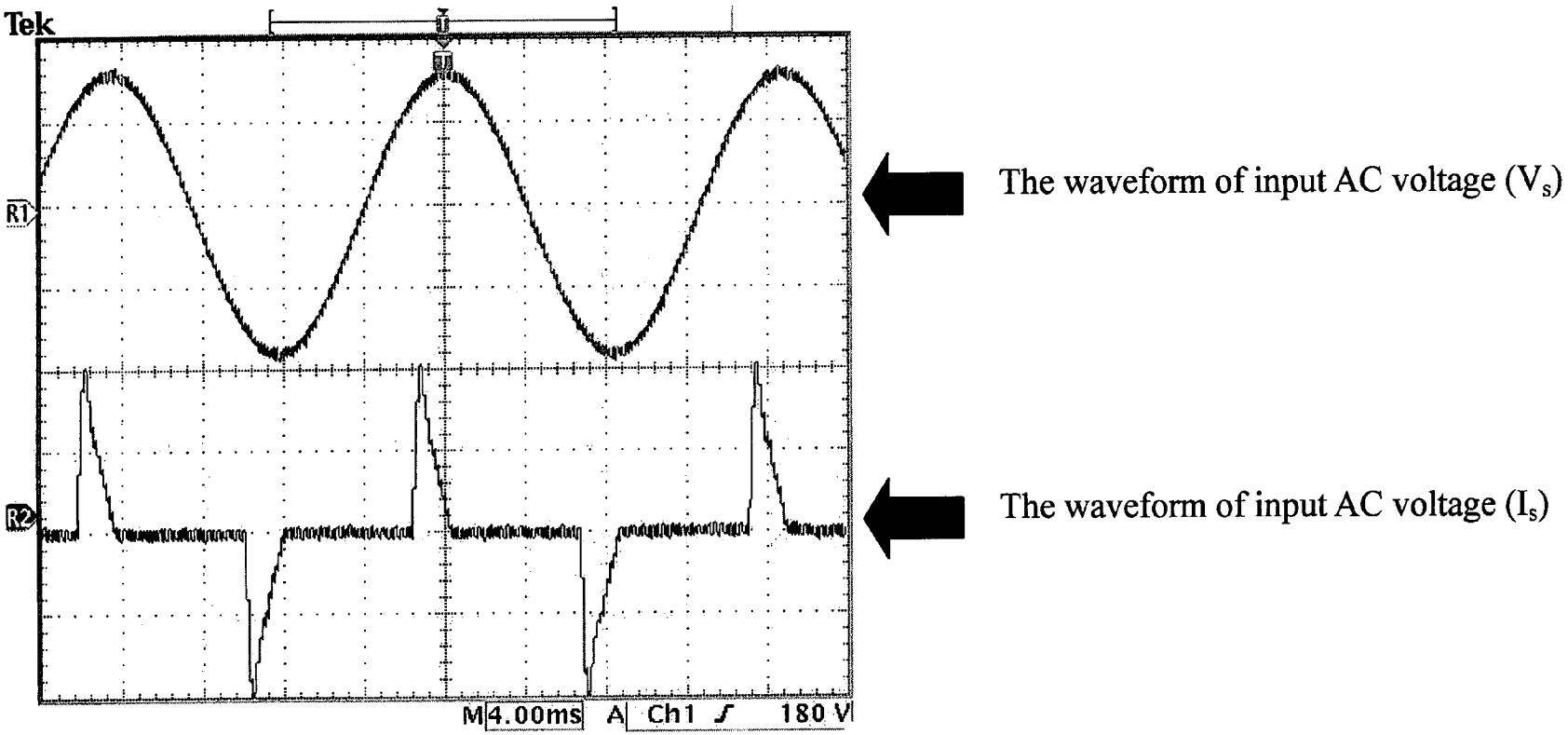
FIG. 2 is a waveform diagram showing an input AC voltage Vs and current Is of the conventional electronic ballast.
Figure 4:
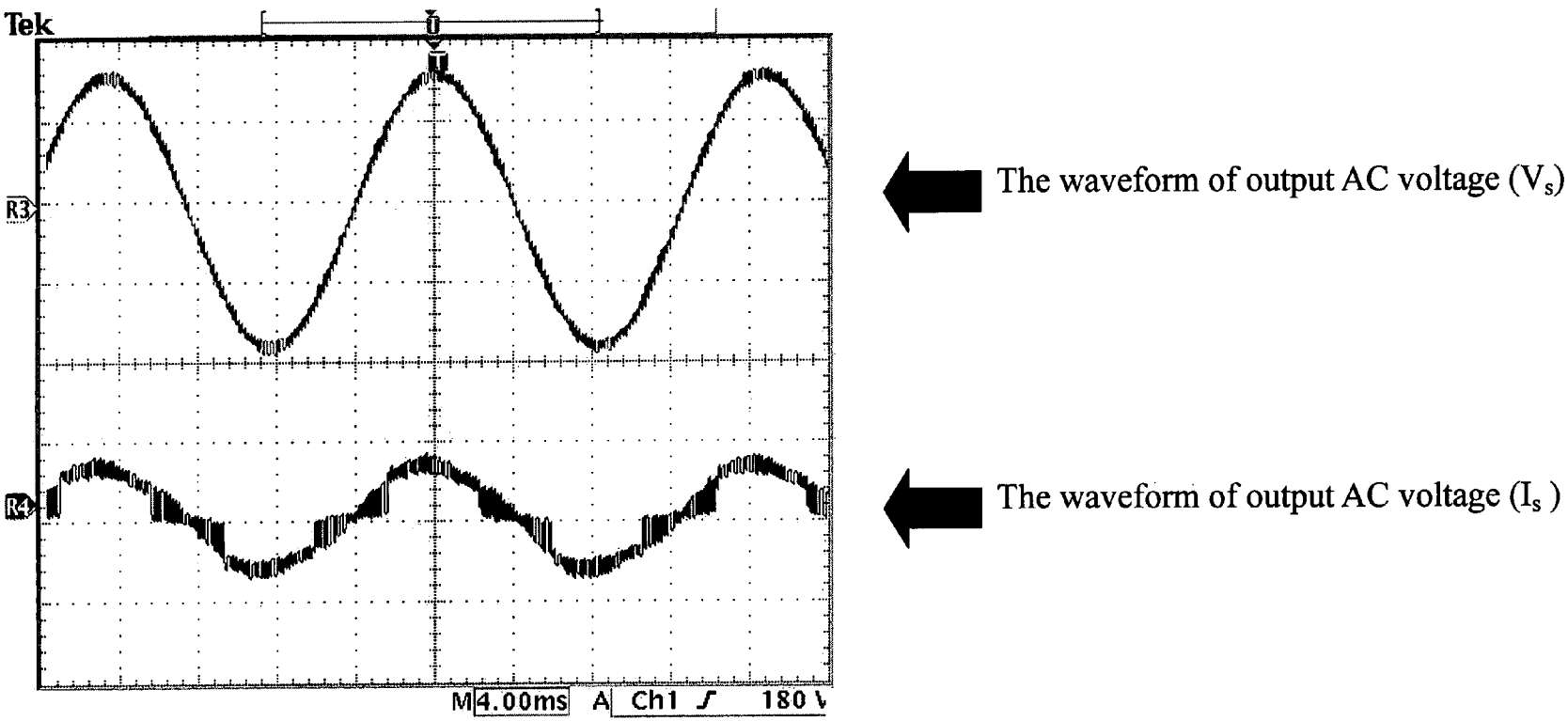
FIG. 4 is a waveform diagram showing an input AC voltage Vs and current Is of the electronic ballast of the present invention.

FIG. 4 is a waveform diagram showing an input AC voltage Vs and current Is of the electronic ballast according to the preferred embodiment of the present invention. As shown in FIG. 4, because of the power factor correction circuit of the present invention, the input AC current Is has a waveform very close to a true sine wave. Compared with the acute impulse waveform of the conventional electronic ballast as shown in FIG. 2, it is obvious that a significant improvement is achieved.

The highly efficient power factor correction circuit provided by the present invention has the following advantages:

(1) The amount of the third order harmonics of the input AC current is reduced. The total harmonic distortion is reduced to below 10%. Therefore the electromagnetic pollution is reduced and the power safety is increased.

(2) The power factor is increased to above 0.95. The overhead of the power supply system is therefore reduced.

(3) The fluctuation of the DC voltage is reduced. The crest factor of the lamp tube's lamp current is reduced to below 1.7. The lifespan of the lamp tube is therefore increased. The reliability of the high frequency oscillation circuit is increased. The overall reliability of the whole electronic ballast is therefore increased as well.

What is claimed is:

1. A power factor correction circuit for an electronic ballast of a fluorescent lamp arranged between a rectifier circuit and a high frequency oscillation circuit of the electronic ballast, wherein an alternating current voltage is rectified by the rectifier circuit, filtered through the power factor correction circuit, and drives the high frequency oscillation circuit to excite the fluorescent lamp, the power factor correction circuit comprising:

a filtering capacitor charge/discharge circuit comprising a plurality of capacitors, wherein said capacitors are charged by a direct current voltage output from the rectifier circuit a series connection and discharge to a load of the filtering capacitor charge/discharge circuit in a parallel connection; and a feedback circuit feeding a high frequency signal from a filament terminal of the fluorescent lamp back to the filtering capacitor charge/discharge circuit so that the high frequency signal is added to the direct current voltage output from the rectifier circuit;

wherein the filter capacitor charge/discharge circuit comprises:

a diode D5 having anode connected to a positive output terminal of the rectifier circuit and cathode connected to a positive input terminal of the high frequency oscillation circuit;

a capacitor C1 and a diode D4 forming a first series connection connecting the cathode of the diode D5 through the capacitor C1, cathode of the diode D4, anode of the diode D4, to a negative output terminal of the rectifier circuit, wherein the first series connection and the load of the filtering capacitor charge/discharge circuit form a discharging path for the capacitor C1;

a diode D3 and a capacitor C2 forming a second series connection connecting the cathode of the diode D5 through cathode of the diode D3, anode of the diode D3, the capacitor C2, to the negative output terminal of the rectifier circuit, wherein the second series connection and the load of the filtering capacitor charge/discharge circuit form a discharging path for the capacitor C2; and a diode D1 and a diode D2 forming a third series connection connecting an interconnection point between capacitor C1 and diode D4 through anode of the diode D1, cathode of the diode D1, anode of the diode D2, cathode of the diode D2, to an interconnection point between the diode D3 and the capacitor C2, wherein the capacitor C1, the diode D1, the diode D2, and the capacitor C2 form a charging path of the capacitor C1 and the capacitor C2.

2. The power factor correction circuit as claimed in claim 1, wherein the feedback circuit comprises:

a capacitor C6 connecting a filament terminal of the fluorescent lamp to an interconnection point between the diode D1 and the diode D2;

a capacitor C3 connecting the interconnection point between the diode D1 and the diode D2 to the negative output terminal of the rectifier circuit; and a capacitor C4 and a diode D6 forming a fourth series connection connecting the interconnection point of the diode D1 and the diode D2 through the capacitor C4, anode of the diode D6, cathode of the diode D6, to the positive output terminal of the rectifier circuit.

* * * * *